US005435217A

United States Patent [19]

Kato et al.

[11] Patent Number: 5,435,217

[45] Date of Patent: Jul. 25, 1995

[54] DISC-SHAPED KNIFE ROTARY CUTTER

[75] Inventors: Toshihide Kato; Toshinao Okihara, both of Mihara, Japan

[73] Assignee: Mitsubishi Jukogyo Kabushiki Kaisha, Tokyo, Japan

[21] Appl. No.: 115,644

[22] Filed: Sep. 3, 1993

[30] Foreign Application Priority Data

Sep. 4, 1992 [JP] Japan ..... 4-260582

[51] Int. Cl.[6] ..... B26D 1/20

[52] U.S. Cl. ..... 83/100; 83/168; 83/169; 83/174; 83/508; 83/658

[58] Field of Search ..... 83/100, 168, 174, 508, 83/508.3, 658, 101, 169, 471, 941; 493/365, 370

[56] References Cited

U.S. PATENT DOCUMENTS

| | | | |
|---|---|---|---|
| 2,554,683 | 5/1951 | Rogers | 83/169 |
| 2,796,933 | 6/1957 | De Gelleke . | |
| 3,135,151 | 6/1964 | Link et al. | 83/100 X |
| 3,508,460 | 4/1970 | Goettsch | 83/56 |
| 3,587,376 | 6/1971 | Hirano | 83/168 X |
| 3,599,518 | 8/1971 | Goettsch | 83/168 X |
| 3,651,723 | 3/1972 | Gallagher, Jr. et al. . | |
| 3,763,748 | 10/1973 | Gallagher, Jr. | 83/658 X |
| 3,830,122 | 8/1974 | Pearl | 83/169 |
| 4,003,276 | 1/1977 | Schmitt | 83/100 |
| 4,137,101 | 1/1979 | Stock | 83/951 X |
| 4,347,771 | 9/1982 | Bradley | 83/174 |
| 4,628,642 | 12/1986 | Zantiotis | 83/174 X |
| 4,685,363 | 8/1987 | Gerber | 83/22 |
| 5,090,281 | 2/1992 | Paulson et al. | 83/13 |
| 5,197,366 | 3/1993 | Paulson et al. | 83/498 |

FOREIGN PATENT DOCUMENTS

| | | |
|---|---|---|
| 0183862 | 6/1986 | European Pat. Off. . |
| 217176 | 12/1908 | Germany . |
| 1915895 | 11/1969 | Germany . |
| 2311505 | 4/1974 | Germany . |
| 3817945 | 9/1989 | Germany . |
| 2090784 | 7/1982 | United Kingdom . |
| 2124523 | 2/1984 | United Kingdom . |
| 9113733 | 9/1991 | WIPO . |
| 9202343 | 2/1992 | WIPO . |

OTHER PUBLICATIONS

Seelinger, "Self Sharpening Slitter", IBM Technical Disclosure Bulletin, vol. 23, No. 12, May 1981, New York, pp. 5576–5577.

*Primary Examiner*—Eugenia Jones

*Attorney, Agent, or Firm*—Rothwell, Figg, Ernst & Kurz

[57] ABSTRACT

An improved disc-shaped knife rotary cutter which has a reduced size and is not complicated in structure as a whole, and which require a knife only on the upper side of a traveling sheet. The knife can be used over a long period and paper powder produced as a result of cutting of a sheet by the knife can be removed by a suction box extending over a full width of the sheet. The improved rotary cutter performs cutting by moving a knife edge portion of a rotating disc-shaped knife into a surface of a sheet being successively fed. On the underside of the traveling sheet, a brush consisting of rod-shaped brush elements is fixed on a backing table over the entire region in the lateral widthwise direction of the sheet. A knife edge of the knife is disposed close to a front end portion of the backing table and upon transfer of the knife in the lateral widthwise direction of the sheet the knife is raised to be disengaged from the brush and the sheet and then it is transferred and set in position. Thereafter, while the knife is being rotated, it is lowered to be engaged with the sheet and again cuts the sheet. Furthermore, grindstones for grinding the knife edge of the disc-shaped knife are provided so as to be movable in the axial direction of a shaft of the disc-shaped knife, and in addition, there is provided a felt immersed in soapy water for peeling off paste from the knife.

13 Claims, 9 Drawing Sheets

DISC-SHAPED KNIFE ROTARY CUTTER

BACKGROUND OF THE INVENTION

1. Field of the Invention

The present invention relates to a disc-shaped knife rotary cutter equipped in a slitter-scorer or the like for cutting mainly soft plate-like bodies such as corrugated cardboard sheets or the like along a traveling direction of the sheets.

2. Description of the Prior Art

At first, description will be made of heretofore known disc-shaped knife rotary cutters for cutting soft plate-like bodies such as corrugated cardboard sheets or the like along a traveling direction of the sheets with reference to FIGS. 6 to 9, each of which depicts known cutters. FIG. 9 is a schematic front view showing a general construction of one of such rotary cutters in the prior art.

The known rotary cutter shown in FIG. 6 is of the type in which disc-shaped rotary knives 20*a* and 20*b* are mounted in an opposed and staggered relationship respectively on rotary shafts 11*a* and 11*b* disposed above and under a sheet pass line. The same disc-shaped rotary knives 20*a* and 20*b* are rotated at a somewhat faster circumferential velocity than a traveling velocity of a sheet (plate-like body) 1 forming a material to be cut, the sheet being fed and pinched between both knives to be sheared.

Next, the known rotary cutter shown in FIG. 7 is of the type that, like the above-described known rotary cutter, has a disc-shaped rotary knife 21 and a grooved backing roll 22 for supporting a traveling sheet 1 mounted on rotary shafts 11*a* and 11*b* disposed above and under a sheet pass line. Cutting is effected by a knife edge of a rotary knife 21 biting into a sheet (plate-like body) 1 forming a material to be cut, the knife projecting to the underside and being engaged with a groove R in the backing 22.

Further, the known rotary cutter shown in FIG. 8 is of the type that has, in place of the grooved backing roll 22 in the above-described known rotary cutter shown in FIG. 7, a brush-like backing roll 19 extending over the maximum sheet width. This backing roll 19 is mounted at the same position, and cutting is effected by a knife edge of a rotary knife 21 biting into a sheet (plate-like body) 1 forming a material to be cut, the knife projecting to the underside and being engaged with the brush portion. The disc-shaped rotary knives 21 in the known rotary cutters shown in FIGS. 7 and 8, also have their knife edge circumferential velocities set at somewhat faster than a sheet traveling velocity.

Now, a cutting position of a corrugated cardboard sheet or the like may be changed and set in various fashions depending upon a configuration of a box to be manufactured, and normally a disc-shaped rotary knife can be transferred from a storage position up to a cutting position by the intermediary of transfer/set means (carrier) and can be set (fixed) at the same position on the shaft via a movable key.

Now description will be made on a general construction of the rotary cutter portion with reference to FIG. 9. As illustrated in this figure, the construction is such that disc-shaped rotary knives 20*a* and 20*b* disposed in opposition to each other above and under a sheet pass line may be rotated synchronously in the opposite directions to each other by making gears 13*a* and 13*b* (fixedly secured to the shaft ends of rotary shafts 11*a* and 11*b*) mesh with each other, and a rotary drive torque may be obtained by making a gear 14 fixedly secured to a shaft end of a motor 12 mesh with the gear 13*b*. In this figure, reference numeral 23 designates bearings fitted in frames 24*a* and 24*b* for pivotably supporting the rotary shafts 11*a* and 11*b*. It is to be noted that in the rotary cutters shown in FIGS. 7 and 8, although there exists a little difference in conditions such as circumferential velocities of a grooved backing roll and a brush-like backing roll, it is ideal to perform forced driving, and from the point of overall construction, the FIGS. 7 and 8 cutters are similar to the rotary cutter shown in FIG. 9.

Next description will be made on the various disadvantages of the heretofore known apparatus. Since the generally known disc-shaped knife rotary cutters are constructed in the above-described manner, it is necessary to equip a pair of carriers 10*a* and 10*b* above and under a sheet 1 to act as a transfer/set means for upper and lower disc-shaped knives 20*a* and 20*b* (or a disc-shaped knife 21 and a grooved backing roll 22) that are opposed to each other at a cutting position on the sheet 1. However, in the known rotary cutter shown in FIG. 8, in view of the structure of the lower backing means (brush-like backing roll 19) the lower carrier 10*b* becomes unnecessary. In addition, in order to cause the above-described upper and lower knives or rollers to rotate in an opposed relationship, it is necessary to provide gears 13*a* and 13*b*, and so, there was a shortcoming in that the rotary shafts 11*a* and 11*b* and a driving apparatus for these shafts became complicated.

Furthermore, upon cutting a corrugated cardboard sheet, there is a problem in that when a knife edge of a rotary knife rotating at a high speed bites into a sheet 1, fine paper powder is produced. Moreover, not only would the produced paper powder adhere to the knife rotary shaft 11, but also a product sheet 15 would be conveyed to a downstream process step with the produced paper powder held adhered to its surface. With regard to removal of the paper powder, effective counter-measures have not been devised so far, and hence, at the time of printing in a box making machine (which forms a separate apparatus), the paper powder adhering to the product sheet surface would transfer to a printing plate and become a principal cause of printing blur.

By the way, the knives 20 and 21 employed in these cutters are commonly disc-shaped knives making use of metallic materials, and in order to realize good cutting capability, a circumferential velocity $V_o$ of the knife 2 is chosen faster than a traveling velocity V of the sheet 1. Thus, damage and deformation of the cutting surfaces are minimized and thus cutting capability is improved. In every one of the above-described type of cutters, cutting is effected by making a sharp knife edge of a disc-shaped knife 2 bite into the sheet (material to be cut) 1, and in view of the fact that the knife 2 is held in sliding contact with the material to be cut 1 at a super-high velocity, deterioration of cutting capability due to abrasion of the knife edge is inevitable, and so, degradation of appearance, linearity and dimensional precision of cut surfaces would arise.

Moreover, in a slitter-scorer that is used in the subsequent step of a double-facer for manufacturing a double-faced cardboard sheet, the paste 31 for sticking a single-faced corrugated cardboard sheet and a liner to each other does not reach a perfectly dried state when they are transferred to the slitter-scorer, and so, at the time of cutting, the following inconvenience would also occur. That is, there was a problem in that at the time of cutting the corrugated cardboard sheet 1, the above-described paste 31 (in an imperfectly dried condition) would adhere to the knife edge portion of the disc-shaped knife made to bite into the corrugated cardboard sheet 1 and would be solidified as shown in FIG. 9. Due to growth of the solidified paste 31, a dulled knife edge would be formed, resulting in damage and deformation of the cutting surfaces, and reduced cutting capability.

As described in the preceding paragraphs, a disc shaped knife rotary cutter in the prior art is constructed so as to cut a sheet traveling along a sheet pass line in the traveling direction by sheet cutting means, the cutting means consisting of a pair of disc-shaped knives disposed above and under the sheet pass line, a disc-shaped knife and a grooved backing roll having a groove formed on its outer circumferential surface so that the disc-shaped knife may fit in the groove with a predetermined gap space retained therebetween, or alternatively, a disc-shaped knife and a brush roll having brush elements planted on its outer circumferential surface. Therefore, the rotary cutter requires a rotary drive unit for rotating a pair of disc-shaped knives, a disc-shaped knife and a grooved backing roll, or a disc-shaped knife and a brush roll disposed in an opposed relationship above and under a sheet pass line in opposite directions to each other, and transfer/set means (carrier) for moving the disc-shaped knife or the grooved backing roll in the axial direction of their shafts in correspondence to a cutting position in the widthwise direction of the sheet. Accordingly, the rotary cutter had a disadvantage in that the entire apparatus became very large in size and complicated, and the manufacturing cost became high.

In addition, upon cutting and working a corrugated cardboard sheet, production of chip powder (paper powder) could not be avoided because of the cutter. The produced paper powder was sputtered to the periphery due to rotation of the disc-shaped knife and the like, and also the powder adhered to sheet support means and a drive section in the cutter or to the surfaces of the traveling sheet. Such condition caused degradation of printing quality in a box-making machine in the subsequent stage and/or remarkable deterioration of a working environment in a hygienic aspect.

Furthermore, in every one of the illustrated types of rotary cutters, during the period when a disc-shaped knife bites into a traveling plate-like body such as a corrugated cardboard sheet and penetrates therethrough, the disc-shaped knife and the plate-like body (material to be cut) would come into sliding contact with each other. Hence dulling of the sharpness of a knife edge of the disc-shaped knife caused by abrasion due to sliding friction cannot be avoided, and thus quality of the cutting surfaces is lowered, or a lot of time is necessitated for dismounting and mounting of a rotary knife for regrinding of a knife edge, which became a principal cause of greatly lowered productivity.

Moreover, in a disc-shaped knife rotary cutter used in a slitter-scorer, since a double-faced corrugated cardboard sheet is cut immediately after it was manufactured in a double-facer in the preceding process step, there was a problem in that paste adheres to a knife edge of a knife and solidifies and thereby a dulled knife edge is formed. There was a disadvantage that cutting capability was deteriorated (lowered) and also quality of the product was greatly degraded in appearance of the cut surfaces of the sheet.

The present invention has been proposed for the purpose of resolving the above-mentioned various problems involved in the prior art.

SUMMARY OF THE INVENTION

It is therefore one object of the present invention to provide a disc-shaped knife rotary cutter which does not necessitate a pair of upper and lower transfer/set means for moving a disc-shaped knife and an opposed disc-shaped knife or backing roller up to a cutting position in the widthwise direction of the sheet.

Another object of the present invention is to provide a disc-shaped knife rotary cutter in which paper powder produced upon cutting a corrugated cardboard sheet can be removed so as not to adhere to a rotary shaft of the disc-shaped knife nor to surfaces of a product sheet.

Still another object of the present invention is to provide a disc-shaped knife rotary cutter in which a knife edge of a disc-shaped knife dulled due to abrasion caused by frictional contact with cut surfaces of a material to be cut, or due to adhesion of imperfectly dried paste from a double-faced corrugated cardboard sheet, can be easily sharpened by regrinding and thus replacement of the disc-shaped knife becomes unnecessary.

According to one feature of the present invention, there is provided a disc-shaped knife rotary cutter for performing cutting of a sheet along a traveling direction of the sheet by making a knife edge portion of a disc-shaped knife bite into the sheet surface, wherein rod-shaped brush elements are positioned on the underside of the traveling sheet and arrayed over the entire region in the widthwise direction of the sheet to form a brush and thereby the sheet is supported from below by the brush.

According to another feature of the present invention, there is provided the above-featured disc-shaped knife rotary cutter which comprises a suction box positioned right under the disc-shaped knife on the underside of a sheet pass line so as to extend over the entire region of the maximum lateral width of the sheet, the box having a part of its upper side opened, and a dust collector connected via a suction duct to the suction box so as to remove paper powder simultaneously with cutting.

According to still another feature of the present invention, there is provided a disc-shaped knife rotary cutter which comprises one set or a plurality of sets of knife edge grinding devices capable of being moved in the axial direction of a shaft of the disc-shaped knife so as to be adapted in position to the disc-shaped knife and also capable of being moved in a diametric direction of the disc-shaped knife so as to be engaged with and disengaged from the knife edge of the disc-shaped knife.

According to yet another feature of the present invention, there is provided a disc-shaped knife rotary cutter which comprises a felt extending over the entire region in the lateral widthwise direction of a traveling corrugated cardboard sheet and having its rear end immersed in soapy water so that upon cutting the sheet a knife edge portion of the disc-shaped knife may bite into the front end of the felt containing soapy water.

According to the present invention, owing to the above-featured construction, a disc-shaped knife is required to be equipped only on the upper side of a traveling sheet, and transfer/set means for moving the knife in the lateral widthwise direction of a sheet (in the axial direction of a rotary shaft of the disc-shaped knife) could be provided in only one set. In addition, since a pressing force applied to a sheet by the disc-shaped knife at the time of cutting is supported by a brush consisting of rod-shaped brush elements, downward escape of the sheet can be avoided, and also, at any arbitrary position in the lateral widthwise direction the disc-shaped knife can be engaged with the sheet.

According to the present invention, when the knife is to be transferred in the lateral widthwise direction of a sheet and set at a new position, the knife is raised to be disengaged from the brush and the sheet and then transferred to and set at the new position, and thereafter the knife is lowered while being rotated to make it again cut the sheet. At that time, since the new set position of the knife is arbitrary, sometimes the knife would be set just on the brush. However, by employing the method for supporting the brush and by having the brush consist of rod-shaped brush elements as will be described later, the knife would be lowered always between a brush element and an adjacent brush element certainly, hence an inconvenience of a brush element being cut would likely never occur, and this fact has been confirmed by experiments.

Also, according to the present invention, since paper powder produced as a result of cutting by the disc-shaped knife can be dealt with by being collected in a dust collector via a suction box and a suction duct, in a box making machine the printing quality can be improved. For instance, the problems one blurs of a printed surface, damage to printing plates and the like caused by adhesion of paper powder can be resolved. Besides, improvements in the deterioration of a working environment caused by scatter of powder and dust, faults caused by adhesion of paper powder to an apparatus, as well as labor saving due to shortened working time relating to cleaning and the like, can be achieved also.

Furthermore, according to the present invention, by assembling the above-mentioned knife edge grinding means within a main body of a rotary cutter, excellent cutting capability can be maintained, and therefore, degradation of a dimensional precision and quality of cut sheets (cut materials) can be avoided. Thereby, time loss caused by replacement of knives as a result of degradation of cutting capability of knife edges is eliminated, and hence improvement in productivity can be achieved.

Moreover, according to the present invention, since soapy water is applied to the knife edge portion via a felt, a soapy water film is formed on the surface of a knife edge, and owing to the capability of the soapy water film, lubrication and prevention of adhesion of paste to the knife edge can be effected, and the original shape of the knife edge of the disc-shaped knife can be maintained.

The above-mentioned and other objects, features and advantages of the present invention will become more apparent by reference to the following description of preferred embodiments of the present invention taken in conjunction with the accompanying drawings.

DESCRIPTION OF THE PREFERRED EMBODIMENTS

Now a basic construction of a disc-shaped knife rotary cutter according to one preferred embodiment will be explained with reference to FIGS. 1 to 3. Also, a construction of an auto-slitter-scorer to which the disc-shaped knife rotary cutter constructed according to the illustrated embodiment of the present invention may be applied, will be described with reference to FIGS. 4 and 5.

Figure 4:
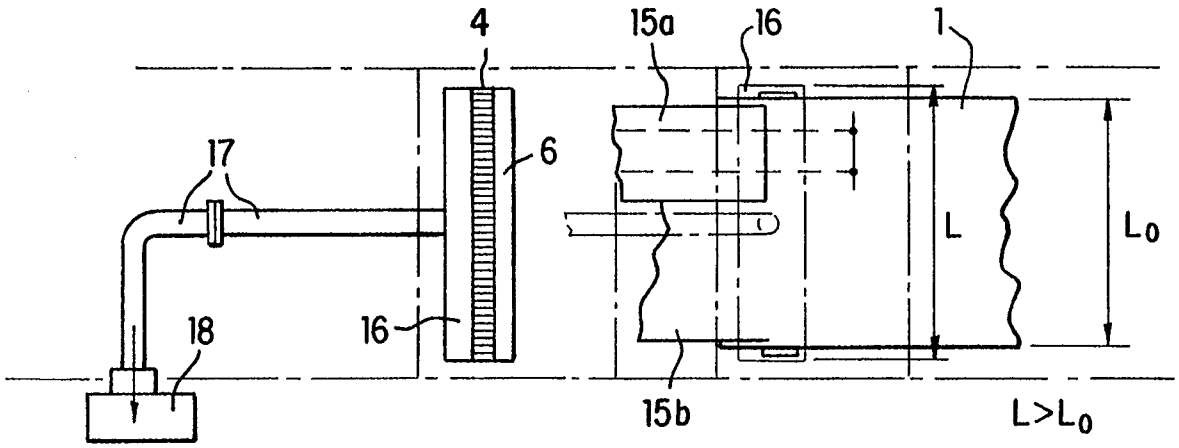
(FIG. 4 shows paper powder removing means according to yet another aspect of the present invention, which can be incorporated in the preferred embodiment shown in FIG. 1), FIG. 4(*a*) being a plan view, and FIG. 4(*b*) being a side view.
Figure 4:
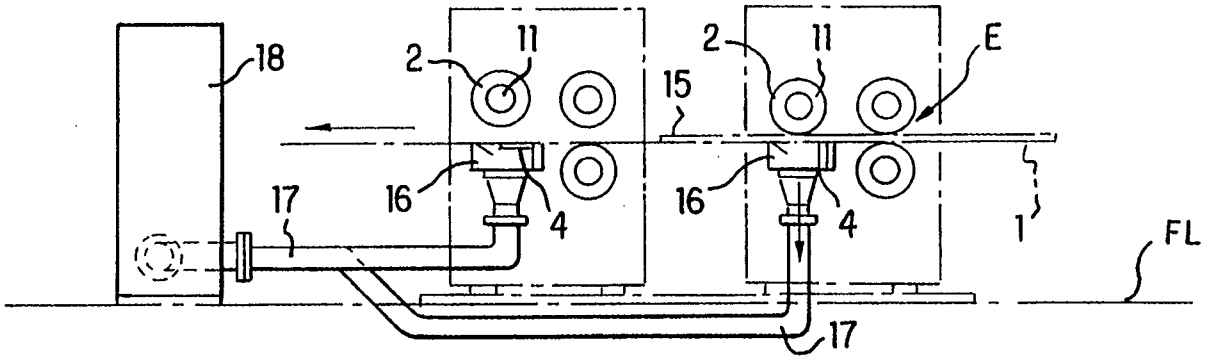
Figure 5B:
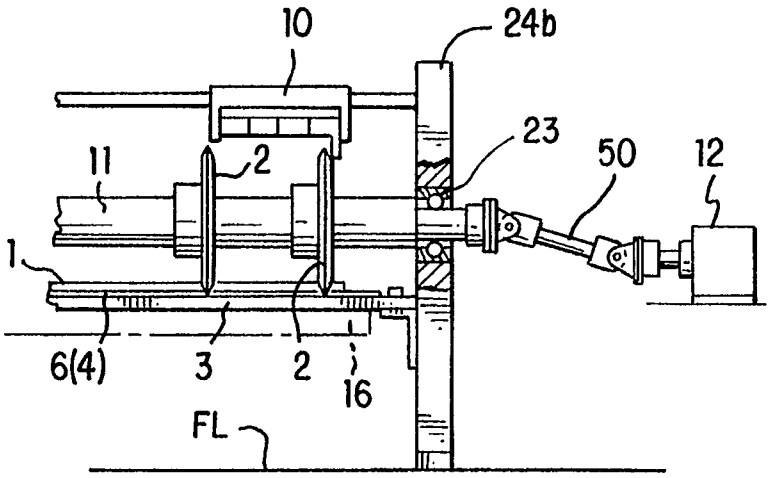
(FIG. 5 shows a slitter-scorer to which the present invention can be applied), FIG. 5(a) being a front view showing a scoring section thereof, and FIG. 5(*b*) being 5 a front view showing a cutting section thereof.
Figure 5A:
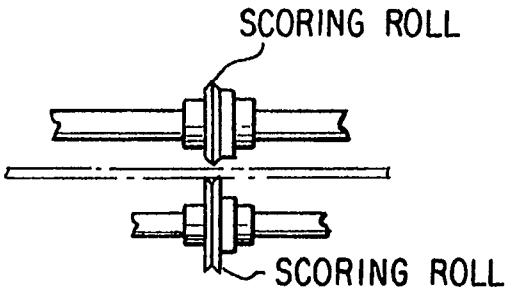
Figure 8:
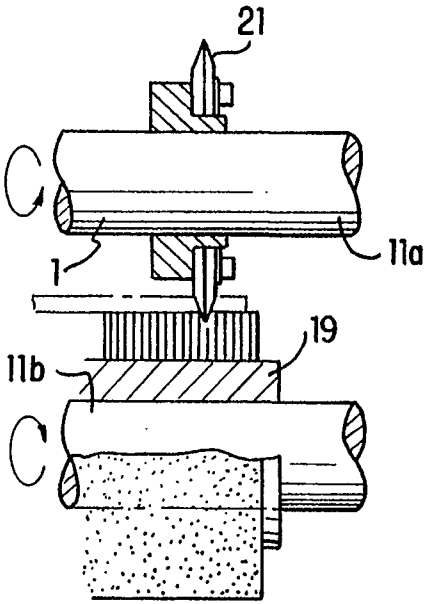
FIG. 8 (PRIOR ART)
FIGS. 6 to 8 are cross-section front views showing essential parts of different types of disc-shaped knife rotary cutters in the prior art.
Figure 7:
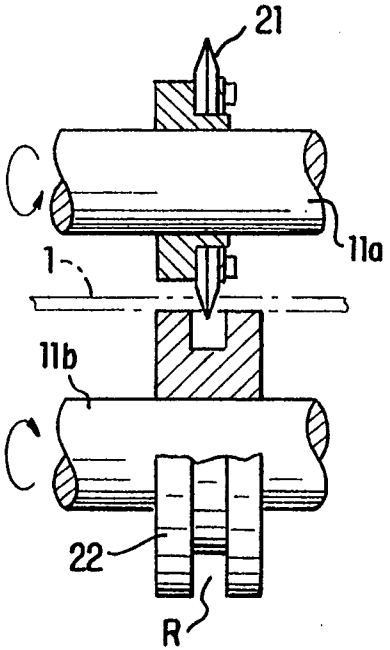
FIG. 7 (PRIOR ART)
Figure 6:
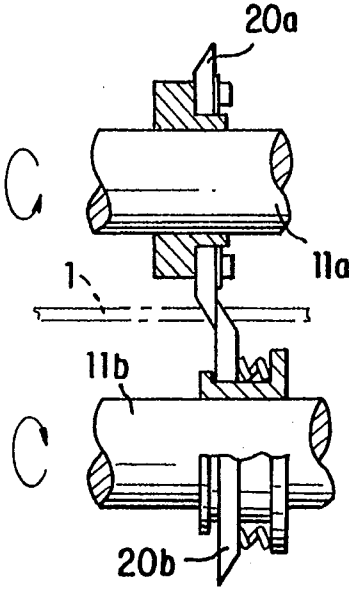
FIG. 6 (PRIOR ART)
Figure 9:
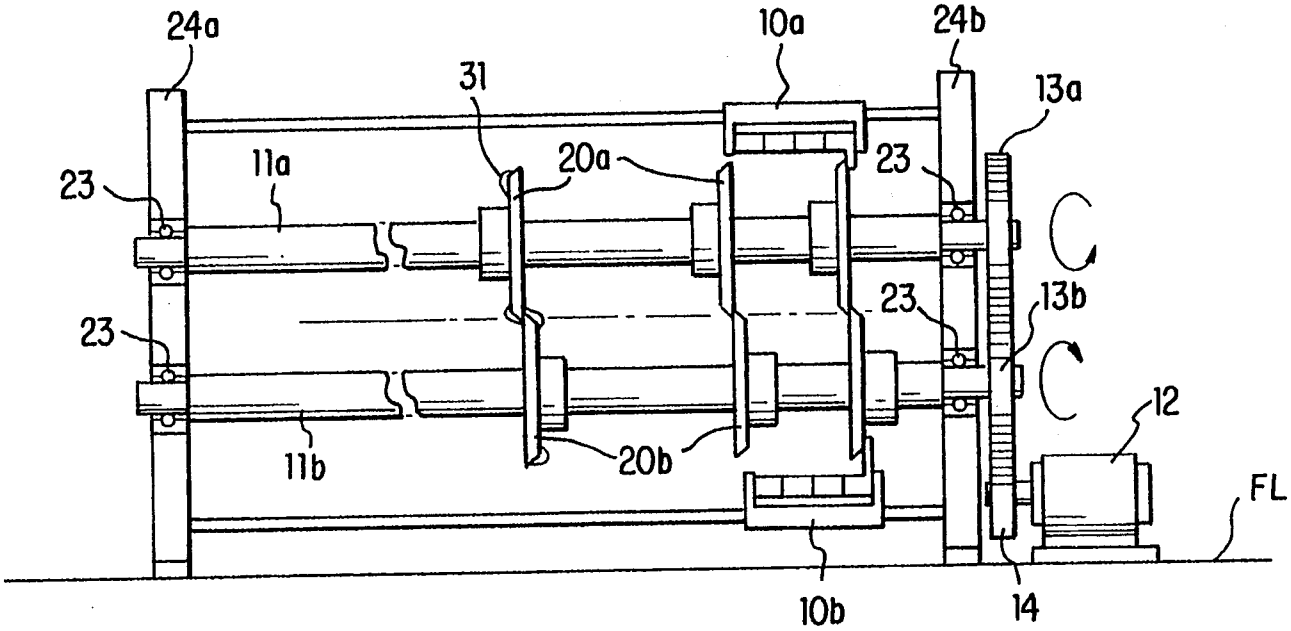
FIG. 9 (PRIOR ART)
FIG. 9 is a front view showing a general construction of a disc-shaped knife rotary cutter in the prior art, which belongs to the type shown in FIG. 6.

An auto-slitter-scorer is an apparatus for carrying out scoring work and cutting work on a continuously traveling corrugated cardboard sheet 1 along its flow direction as shown in FIG. 4, and it achieves its function with a scoring section shown in FIG. 5(*a*) and with a cutting section shown in FIG. 5(*b*).

The illustrated disc-shaped knife rotary cutter according to the present invention is positioned above a sheet 1 being fed successively as shown in FIG. 1, the rotary cutter comprising a disc-shaped knife 2 which can be moved to and set at any arbitrary position in the lateral widthwise direction of the sheet (in the axial direction of a shaft of the knife). The disc-shaped knife 2 is made to bite into the sheet 1 while it is rotated at a high speed, and also on the underside of the sheet 1 is provided a brush consisting of rod-shaped brush elements 4 fixedly secured to a backing table 3 over the entire region in the lateral widthwise direction of the sheet 1, the brush elements 4 acting as means for restricting downward escape of the sheet 1 against a pressing force of the disc-shaped knife 2 generated upon cutting of the sheet. By the way, functions required for the above-mentioned support means of the traveling sheet 1 include a support strength capable of resisting against the pressing force of the disc-shaped knife 2 generated upon cutting of the sheet as well as a capability of being engaged with the disc-shaped knife 2 at any arbitrary position along the lateral widthwise direction of the sheet. To that end, as shown in FIG. 1(*c*) and in FIG. 1(*d*) which is a detailed partial side view of a part G in FIG. 1(*b*), the rod-shaped brush elements 4 preferably are elements having wire diameters in the range of 0.5 m/m–5 m/m, and they are arrayed in one lateral row at predetermined pitches (in the range of 0.5 m/m–10 m/m).

More particularly, the brush has the structure that after brush elements 4 have been inserted in respective grooves 3a formed at a predetermined pitch on a backing table 3 as shown in FIG. 1(*e*), they are fixed in position by pressing them with a guide 6 via flat head bolts 5. In these figures, reference numeral 7 designates a rubber sheet stuck to the lower surface of the guide 6 along the lateral widthwise direction of the sheet, and it functions to prevent the rod-shaped brush elements 4 inserted in the respective grooves 3*a* from slipping out. The above-described backing table is severed in a plurality of units along the lateral widthwise direction of the sheet, and the respective backing member units can be fixed to a bracket 9 via a plurality of bolts. It is to be noted that a fixing hole in the backing table 3 through which the bolt 8 is to be inserted is formed in an elongated shape, and hence it is possible to move the backing table 3 back and forth so that a gap distance between the knife edge and the backing table 3 can be finely adjusted. Under the above-mentioned construction, the rod-shaped brush elements 4 can be reinserted and exchanged one by one by loosening the flat-head bolts 5, or else the brush can be replaced as each brush unit by demounting and mounting the bolts 8. The backing table 3 on which the brush elements 4 are fixedly secured has the brush elements 4 fixed at a point A and also supports the same brush elements 4 up to a point B at the tip end of the backing table 3 along a parallel plane. The knife edge of the disc-shaped knife 2 normally penetrates the sheet 1 up to its underside surface, and is set in position with a very small gap space S retained between the knife edge and the tip end of the projected portion of the backing table 3.

Next, description will be made of the function achieved by the above-described construction. An action force in the lateral direction of the brush (a push through force), generated by engaging the disc-shaped knife 2 with the brush fixedly secured to the backing table 3 over the entire region in the lateral widthwise direction of the sheet 1, would be avoided by bending deformation of the rod-shaped brush elements 4 with their fulcrums placed at the above-described point A. And since a sufficient distance P is maintained between the point A and the point B, their rigidity in the horizontal direction at the action point B would be small. Thus, inconveniences such as the rod-shaped brush elements 4 being cut as a result of contact with the disc-shaped knife 2, or a life of the brush elements 4 being shortened as a result of friction, would be eliminated. On the other hand, since the pressing force applied to the brush via the sheet 1 at the time of cutting can be supported by the front edge portion of the guide 6 in view of its structure, an acting force upon the rod-shaped brush elements 4 can be greatly reduced. In addition, the rod-shaped brush elements 4 would be bent downwards about a fulcrum point at the point B, and so, under a short span a sufficient rigidity (supporting force) can be obtained. As the illustrated rotary cutter is constructed as described above and operates in the above-described manner, it can fulfil the conditions required for sheet support means such that a disc-shaped knife 2 can be disposed at any arbitrary position in the widthwise direction, the sheet support means can reliably support a sheet against a pressing force exerted from the upper side as a result of cutting, and other problems remaining in relation to the heretofore known disc-shaped knife rotary cutter such as durability of a brush should be resolved.

In the illustrated rotary cutter, owing to the fact that a sheet 1 is supported from below via a brush consisting of rod-shaped brush elements 4, a disc-shaped knife 2 is only necessary above a sheet pass line, and accordingly, only one transfer/set means (a carrier) for moving the knife to a cutting position is on the upper side. Besides, with regard to rotary drive means for a disc-shaped knife, the structure becomes simple as compared to the driving system in the prior art such that an end of a rotary shaft 11 of a disc-shaped knife 2 may be connected via a universal joint 50 to a tip end of a shaft of a motor 12 as shown in FIG. 5, and various other advantages as will be described later can be offered by the disc-shaped knife rotary cutter according to the present invention.

Figure 1A:
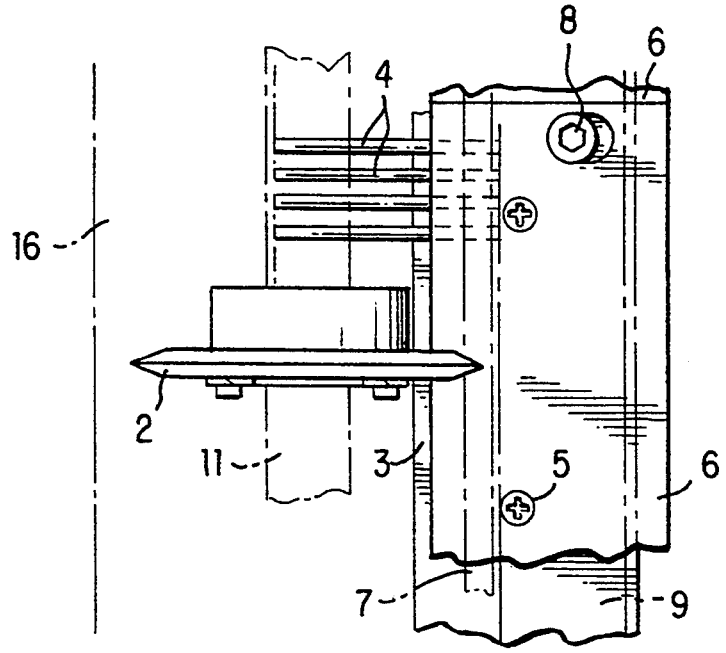
FIG. 1 shows an essential part of a disc-shaped knife rotary cutter according to one preferred embodiment of the present invention, FIG. 1(*a*) being a plan view, FIG. 1(*b*) being a side view, FIG. 1(*c*) being a front view, FIG. 1(*d*) being a detailed partial side view of a part G in FIG. 1(*b*), and FIG. 1(*e*) being a partial cross-section view taken along line K—K in FIG. 1(*d*) as viewed in the direction of arrows.
Figure 1B:
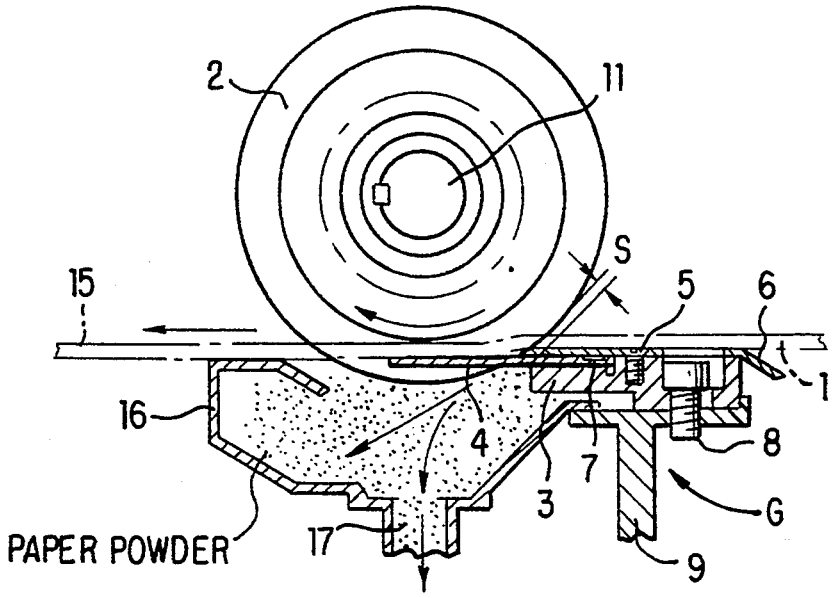
Figure 1D:
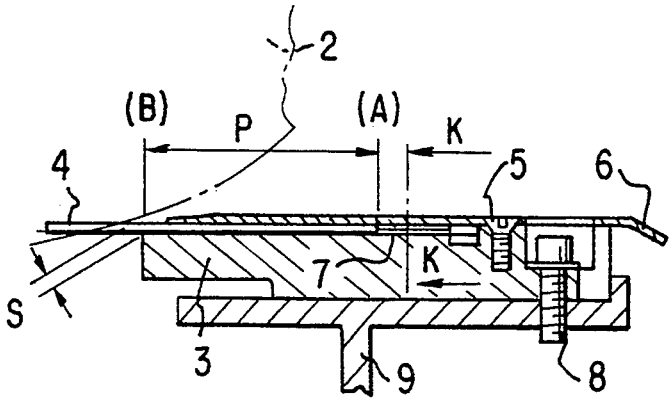
Figure 1E:
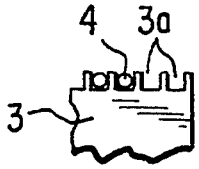
Figure 1C:
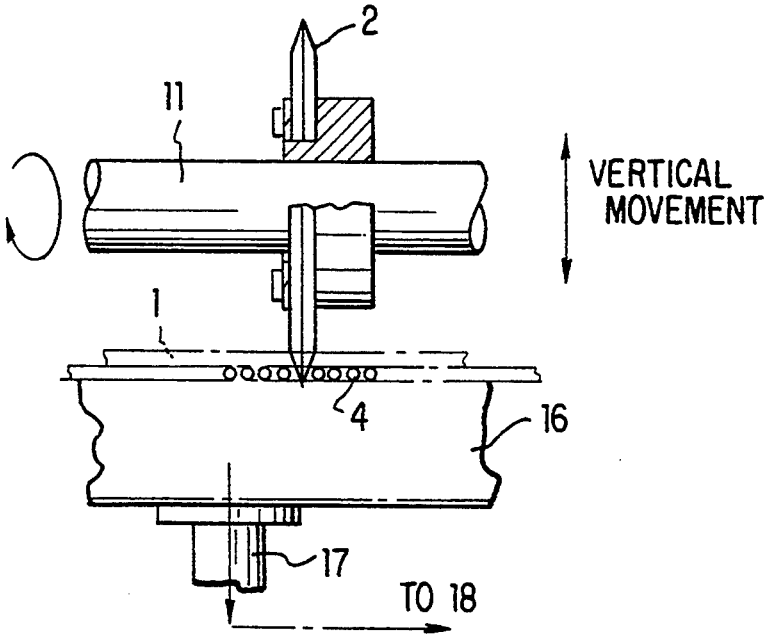
Figure 2A:
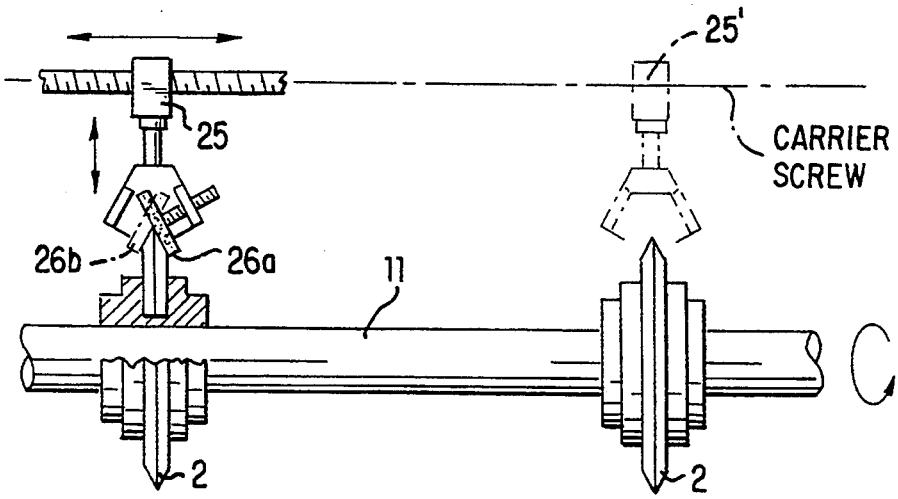
(FIG. 2 shows a knife edge grinding means according to another aspect of the present invention which can be incorporated in the preferred embodiment shown in FIG. 1), FIG. 2(*a*) being a front view, FIGS. 2(*b*) to 2(*d*) being schematic front views of different types of grindstones available in the knife edge grinding means, and FIG. 2(*e*) being a side view of a part of the knife edge grinding means.
Figure 2B:
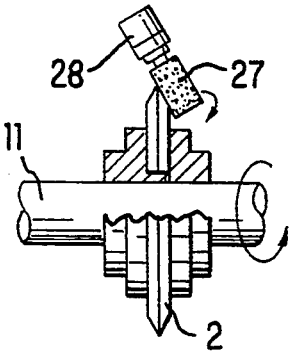
Figure 2C:
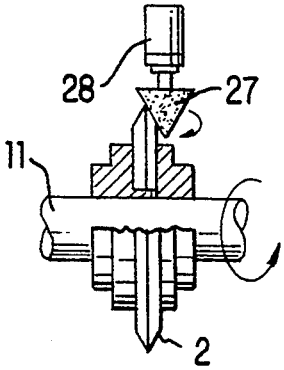
Figure 2D:
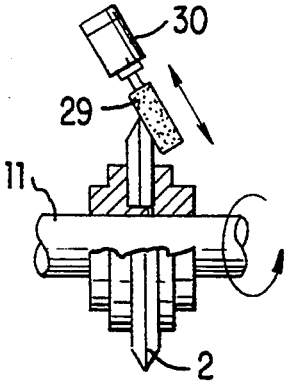
Figure 2E:
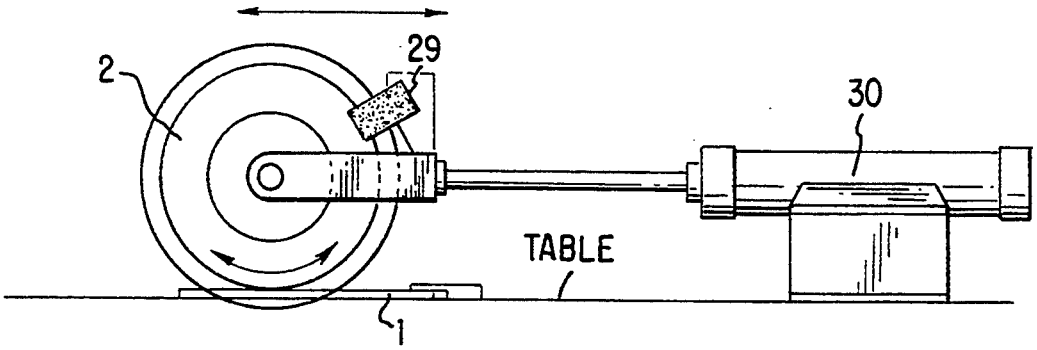

Now, in the prior art there was also the problem that resulted from making a knife edge of a disc-shaped knife 2 rotating at a high speed bite into a corrugated cardboard sheet 1 at the time of cutting the sheet 1, i.e. production of fine paper powder. The produced paper powder would scatter and adhere to a rotary shaft 11 of the knife 2, and also the paper powder would be conveyed to a downstream step of the process while adhering to the surface of a product sheet 15. The rotary cutter according to the present invention is provided with a paper powder removing device capable of resolving such problem in the prior art. As a basic structure of this paper powder removing device, as shown in FIG. 4 in a disc-shaped knife rotary cutter engaged with a corrugated cardboard sheet from its upper side (from only one side), a suction box 16 is positioned under a sheet pass line in the portion of a disc-shaped knife 2 and formed to have a width L larger than the maximum sheet width Lo. This suction box 16 is connected to a dust collector 18 via a suction duct 17. The above-mentioned suction box 16 is formed such that a part of its upper side surface is opened as an air intake port as shown in FIG. 1(b).

Next, description will be made of the function of the above-described paper powder removing device. A corrugated cardboard sheet 1 travels nearly horizontally along a sheet pass line, and it is slitted at a predetermined position by rotation of a disc-shaped knife 2 engaged therewith from above. In the prior art, there was an inconvenience that paper powder produced by this slitting operation scattered and as a result of floating in random directions the paper powder adhered to the surface of the corrugated cardboard sheet and was conveyed to the downstream jointly with the sheet. However, in the illustrated rotary cutter, as a result of operation of the dust collector 18, paper powder can be sucked and removed via the suction box 16 and the suction duct 17 blocked by the corrugated cardboard sheet 1 traveling above the suction box and held at a negative pressure. Accordingly, the corrugated cardboard sheet 1 can be transferred to the downstream stage in a clean state. In addition, adhesion of paper powder to the respective parts of the rotary cutter is also reduced, and so work relating to cleaning and the like decreases. It is to be noted that with regard to the structure of the portion of the suction box 16, though omitted from illustration, various different types of structures could be employed, for instance, such that the suction box is divided into a plurality of sub-boxes aligned in the widthwise direction by means of partition plates and only necessary ones of the divided sub-boxes are operated depending upon a width of the traveling sheet.

FIG. 2 shows a knife edge grinding means equipped in a disc-shaped knife rotary cutter according to one preferred embodiment of the present invention. In this rotary cutter, one set or a plurality of sets of knife edge grinding means constructed so as to be detachably mounted to a knife edge of a disc-shaped knife are additionally equipped in the heretofore known type of rotary cutter. This knife edge grinding means can be variably set at any position in the axial direction of a rotary shaft 11 corresponding to the position of a disc-shaped knife 2 with the aid of transfer means, and it can grind the knife edge of the disc-shaped knife 2 by being engaged with a rotating disc-shaped knife 2 at the time of cutting work or at any arbitrary time.

Now a number of examples of construction of the knife edge grinding means will be explained with reference to FIG. 2. FIG. 2(*a*) illustrates a basic construction, in which disc-shaped grindstones 26*a* and 26*b* are mounted on a set of movable tables 25 whose position can be set in correspondence to the position of a disc-shaped knife 2, so that the grindstones 26*a* and 26*b* may be positioned on the respective side surfaces of the disc-shaped knife 2 and aligned with the knife edge angles of the disc-shaped knife 2. The grindstones 26*a* and 26*b* can be moved in the directions indicated by solid line arrows in FIG. 2 via a cylinder and other means not shown so that they can be engaged with and disengaged from the knife edge portions of the respective disc-shaped knives. The engaging/disengaging functions of the disc-shaped grindstones 26*a* and 26*b* are provided under the consideration that in response to a dulled state of cutting sharpness of a knife edge, if necessary, grinding can be effected appropriately. However, with regard to an operation method in which a plurality of sets of grindstones are equipped and always held in sliding contact with the disc-shaped knives by applying a predetermined contact pressure, various different types of methods are conceived.

FIGS. 2(*b*) and 2(*c*) illustrate modified embodiments in which the above-described disc-shaped grindstone 26 is replaced by a circular conical or a circular pillar-shaped grindstone 27, and while the grindstone 27 is pivotably supported from a housing 28, it is engaged with the knife edge portion of the disc-shaped knife and thereby it is passively rotated. Another embodiment shown in FIG. 2(*d*) is constructed in such manner that a grindstone 29 is engaged with a knife edge portion and it is obliquely moved (obliquely reciprocated) at an inclination angle corresponding to a knife edge inclination angle of the rotating disc-shaped knife as driven by a cylinder 30. With regard to behaviors of the grindstones 26, 27 and 29 engaged with the knife edge portion of the disc-shaped knife 2, besides the illustrated examples, various examples of application such as a type consisting of selective combinations of the above-described examples are conceived. In addition, the above-described knife edge grinding means according to the present invention is equally applicable to a rotary cutter of the type that a rotating disc-shaped knife 2 is moved relative to a fixed plate-like body (material to be cut) 1 as shown in FIG. 2(*e*) or a rotary cutter of the type that a sheet (plate-like body) 1 is slit by upper and lower rotating slitter knives 20*a* and 20*b* as pinched therebetween described previously in connection to the prior art. Since the knife edge grinding means according to the present invention is constructed in the above-described manner, it can grind a knife edge of a disc-shaped knife 2 by being mounted to a cutter main body either continuously or at an appropriate timing, hence always good cutting capability can be maintained, and degradation of cutting precision and quality (appearance) of cut products can be avoided. Further, time loss relating to exchange of knives as a result of dulling of cutting sharpness is reduced, and therefore, various advantages as will be described later can be obtained.

Figure 3A:
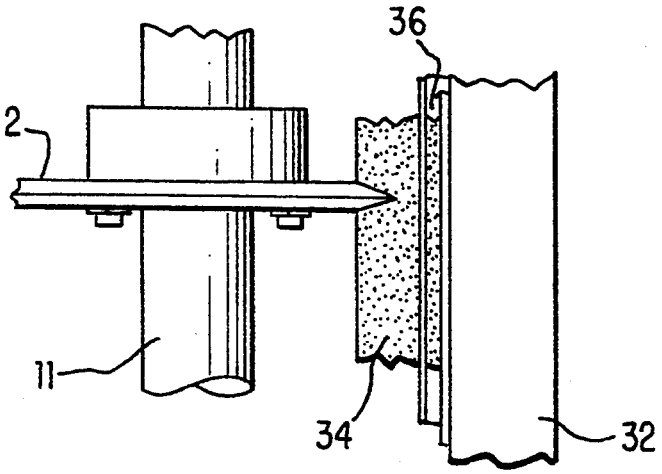
(FIG. 3 shows paste peel-off means for a disc-shaped knife according to still another aspect of the present invention, which can be incorporated in the preferred embodiment shown in FIG. 1), FIG. 3(*a*) being a plan view of an essential part of the paste peel-off means, FIG. 3(*b*) being a side view of the paste peel-off means, and FIG. 3(*c*) being a front view of the essential part.
Figure 3C:
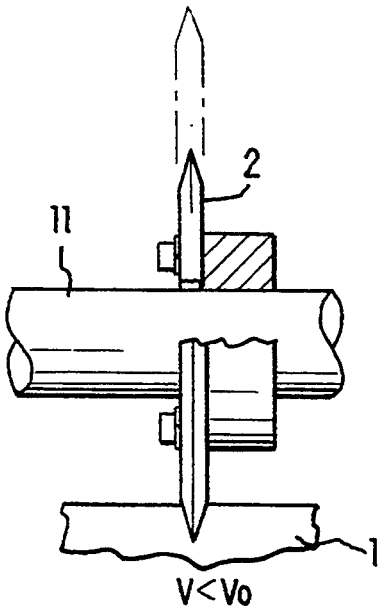
Figure 3B:
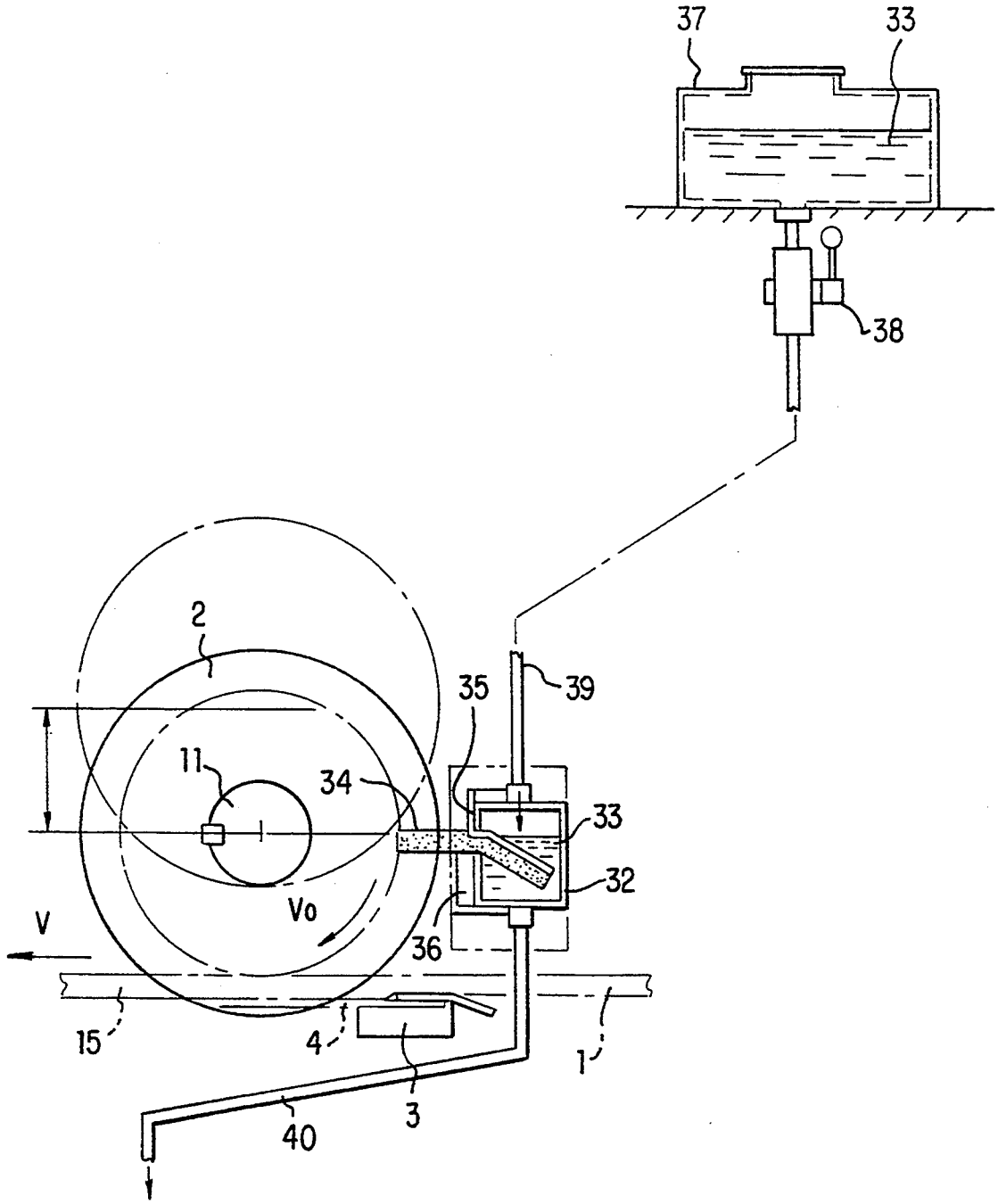

Next, a disc-shaped knife rotary cutter according to the present invention shown in FIG. 3 has been proposed as a counter-measure for dealing with various inconveniences which may occur when the rotary cutter is equipped in a slitter-scorer, such inconveniences arising as a result of the fact that at the time of cutting a double-faced corrugated cardboard sheet 1 produced by a double-facer in the just preceding process step, imperfectly dried sticking paste 31 would adhere to a knife edge portion of a disc-shaped knife 2 and would solidify thereon. In the following, description will be made on a basic construction and function of this rotary cutter. As a basic structure, the rotary cutter comprises a felt 34 extending over the entire region in the lateral widthwise direction of a double-faced corrugated cardboard sheet 1 and having its rear end immersed in a soapy water 33 within a knife-oiler 32 as shown in FIG. 3. In this figure, reference numeral 35 designates a clamp for fixing a front end of the felt 34 so as to be partly projected from the knife-oiler 32, and numeral 36 designates an auxiliary container for collecting soapy water leaked out externally via the felt 34. The soapy water 33 is fed from a tank 37 disposed above the rotary cutter through a cock 38 and a conduit 39 to the knife oiler 32, and surplus soapy water within the knife oiler 32 (or soapy water to be exhausted) is exhausted to a predetermined location via a drain pipe 40. After the disc-shaped knife 2 has been moved in its axial direction at the position shown by a single-dot chain line in FIG. 3 up to a predetermined position corresponding to a slitting position of the corrugated cardboard sheet 1 and has been set at that position, while it is rotating it is lowered up to the slitting position, and is adapted to be engaged with the front end of the above-described felt 34. Accordingly, the front end portion of the felt 34 is slit by the disc-shaped knife 2 and grips the knife edge portion of the disc-shaped knife 2, so that the soapy water 33 sucked up via the felt 34 can be applied to the knife edge of the disc-shaped knife. Next, description will be made of the function of this aspect of the invention. The soapy water 33 has a high surface tension, and so, by applying the soapy water to the knife edge of the knife 2 via the felt 34, a soapy water film can be formed on the surface of the knife edge, and therefore, there is an effect of causing paste 31 tending to adhere to the knife edge to peel off and drop. Thus, since the knife can be maintained always in its original configuration, good cut surfaces of a corrugated cardboard sheet can be obtained.

The means for removing paste adhering to the disc-shaped knife proposed in association with the present invention is constructed and operates in the above-described manner, and therefore, it can be equally applied to various types of rotary cutters other than the illustrated embodiment.

As will be obvious from the detailed description of the preferred embodiments above, the disc-shaped knife rotary cutter according to the present invention has the characteristic construction that as a backing member for a sheet to be cut, a brush consisting of rod-shaped brush elements arrayed in parallel in one lateral row is employed to minimize a sliding contact resistance in the lateral widthwise direction when the knife edge of the disc-shaped knife is engaged with the brush and also to obtain a sufficient support strength (rigidity) against a pressing force upon cutting which is exerted upon the brush from above via the sheet. Consequently, the following advantages can be obtained:

(1) The disc-shaped knife can be set at any arbitrary position in the widthwise direction in correspondence to a slitting position, and moreover, since the disc-shaped knife is disposed only on the upper side of a traveling sheet, only one set of transfer/set means (carrier) to be used at the time of moving the disc-shaped knife in the widthwise direction is necessitated.

(2) In relation to the above-mentioned structural feature, a rotary drive system for the disc-shaped knife becomes simpler.

(3) Due to the above-mentioned reasons, the entire rotary cutter system can be reduced in size, and great reduction of manufacturing cost as well as lowering of running cost can be achieved.

In addition, according to another aspect of the present invention, the disc-shaped knife rotary cutter is associated with a paper powder removing device composed of a suction box disposed under a cutting portion close to a sheet pass line and other members, so that scattering paper powder and paper powder adhered to the lower surface of a traveling corrugated cardboard sheet can be sucked and removed. Therefore, the following advantages can be obtained:

(1) Printing quality in a box-making machine is improved, failure and troubles in various equipments caused by scattering of paper powder are reduced, and a working environment from a hygienic aspect can be improved.

(2) Labor-saving can be achieved in miscellaneous works for maintenance, inspection, repairs, cleanings and the like.

Moreover, according to still another aspect of the present invention, the disc-shaped knife used as cutting means for a plate-like body (material to be cut) can be reground while being kept mounted to the rotary cutter either continuously or only at the time when it is needed. Therefore, the following advantages can be obtained:

(1) Always, an excellent cutting capability of the disc-shaped knife can be maintained.

(2) The work of replacing or regrinding the disc-shaped knife as a result of dulling of a cutting sharpness becomes unnecessary, and so, time loss caused by such work is eliminated.

(3) In relation to the advantage (2) above, preparatory work by an operator can be simplified, and so, great improvement in productivity can be achieved.

Furthermore, according to yet another aspect of the present invention since soapy water is applied to the knife edge portion of the disc-shaped knife upon cutting a corrugated cardboard sheet, the following advantages can be obtained:

(1) A soapy water film is formed on the knife edge portion, and thereby deformed and dulled knife edges caused by adhesion and solidification of sticking paste can be avoided.

(2) As a result of the lubricating effect of a soapy water coating film, cutting capability (life) of a knife can be prolonged, and with respect to appearance of the cut surfaces of a product sheet, improvements in the quality of a product box can be achieved.

(3) A working time relating to replacement of knives and cleaning of knife edges can be shortened, and so great improvements in an availability factor (productivity) can be realized.

Since many changes and modifications can be made to the above-described constructions without departing from the spirit of the present invention, it is intended that all matter contained in the above description and illustrated in the accompanying drawings shall be interpreted to be illustrative and not in a limiting sense.

What is claimed is:

1. A rotary cutter apparatus for cutting sheet material which is traveling in a feed direction, the apparatus comprising:

a disc-shaped knife having an edge for cutting the traveling sheet material;

a drive for rotating the disc-shaped knife; and a brush disposed below the disc-shaped knife for supporting the sheet material as the sheet material is moved in the feed direction, the brush including a plurality of rod-shaped brush elements, each element having a longitudinal axis which is substantially parallel to the feed direction in which the sheet material travels, the brush being disposed over a region extending across a full width of the sheet material;

whereby the elongated rod-shaped brush elements engage the underside of the sheet material and support the sheet material from below during cutting thereof by the disc-shaped knife.

2. An apparatus as claimed in claim 1, wherein a backing member with a forward tip end is provided beneath the brush to support the brush, the brush has a width and a length, and the backing member extends across the full width of the brush in a lateral direction and along a predetermined portion of the length of the brush in a longitudinal direction, and the disc-shaped knife is disposed above the forward tip end of the backing member.

3. An apparatus as claimed in claim 2, further comprising a paper powder removing device which includes a suction box disposed beneath the disc-shaped knife, the suction box extending across at least the full width of the sheet material and having an upper side that includes an open portion for removing paper powder, the suction box being attached to a suction duct which conveys paper powder away from the sheet material.

4. An apparatus as claimed in claim 1, wherein the plurality of rod-shaped brush elements are arranged in a single row with the elements parallel to each other to form the brush.

5. An apparatus as claimed in claim 4, further comprising a paper powder removing device which includes a suction box disposed beneath the disc-shaped knife, the suction box extending across at least the full width of the sheet material and having an upper side that includes an open portion for removing paper powder, the suction box being attached to a suction duct which conveys paper powder away from the sheet material.

6. An apparatus as claimed in claim 1, further comprising a paper powder removing device which includes a suction box disposed beneath the disc-shaped knife, the suction box extending across at least the full width of the sheet material and having an upper side that includes an open portion for removing paper powder, the suction box being attached to a suction duct which conveys paper powder away from the sheet material.

7. An apparatus as claimed in claim 1, further comprising at least one set of knife edge grinding devices which are movable in an axial direction of a shaft of the disc-shaped knife to be aligned laterally with the knife, and in a direction transverse to the knife shaft to be selectively engaged and disengaged with the edge of the knife.

8. A rotary cutter apparatus for cutting sheet material, the apparatus comprising:

a disc-shaped knife having an edge for cutting the sheet material;

a drive for rotating the disc-shaped knife;

a felt for lubricating the knife edge and preventing adherence of paste from the sheet material to the knife, the felt extending laterally in a direction across a width of the sheet material and having first and second ends, the first end of the felt being immersed in a lubricant solution and the second end of the felt being positioned above the sheet material to be cut by the knife edge, the lubricant solution being absorbed by the felt; and a brush disposed below the disc-shaped knife for supporting the sheet material as the sheet material is moved in a feed direction, the brush including a plurality of rod-shaped brush elements, each element having a longitudinal axis which is substantially parallel to the feed direction in which the sheet material is moved, the brush being disposed over a region extending across a full width of the sheet material;

whereby the disc-shaped knife is moved into cutting engagement with the sheet material with a portion of the knife edge cutting through the second end of the felt and being coated with the lubricant solution to prevent the paste from the sheet material from adhering to the knife, and the elongated rod-shaped brush elements engage the underside of the sheet material and support the sheet material from below during cutting thereof by the disc-shaped knife.

9. An apparatus as claimed in claim 8, wherein a backing member with a forward tip end is provided beneath the brush to support the brush, the brush has a width and a length, and the backing member extends across the full width of the brush in a lateral direction and along a predetermined portion of the length of the brush in a longitudinal direction, and the disc-shaped knife is disposed above the forward tip end of the backing member.

10. An apparatus as claimed in claim 8, wherein the plurality of rod-shaped brush elements are arranged in a single row with the elements parallel to each other to form the brush.

11. An apparatus as claimed in claim 8, further comprising a paper powder removing device which includes a suction box disposed beneath the disc-shaped knife, the suction box extending across at least the full width of the sheet material and having an upper side that includes an open portion for removing paper powder, the suction box being attached to a suction duct which conveys paper powder away from the sheet material.

12. An apparatus as claimed in claim 8, further comprising at least one set of knife edge grinding devices which are movable in an axial direction of a shaft of the disc-shaped knife to be aligned laterally with the knife, and in a direction transverse to the knife shaft to be selectively engaged and disengaged with the edge of the knife.

13. An apparatus as claimed in claim 8, wherein the lubricant solution is a soap and water solution.

* * * * *

UNITED STATES PATENT AND TRADEMARK OFFICE

CERTIFICATE OF CORRECTION

PATENT NO. : 5,435,217

DATED : July 25, 1995

INVENTOR(S) : Toshihide Kato et al.

It is certified that error appears in the above-identified patent and that said Letters Patent is hereby corrected as shown below:

In the Abstract: Line 3, "require" should be -- requires --;
In the Specification: Col. 2, line 11, before "overall" insert -- general --; Col. 5, line 30, "one" should be -- of --; Col. 8, line 31, after "i.e." insert a comma; Col. 8, line 61, delete "to the"; Col. 11, line 38, delete the comma; Col. 11, line 65, delete "so,"; Col. 11, line 68, after "invention" insert a comma.

Signed and Sealed this

Sixth Day of October, 1998

Bruce Lehman

*Attest:*

BRUCE LEHMAN

*Attesting Officer*

*Commissioner of Patents and Trademarks*